United States Patent [19]

Kanski

[11] Patent Number: 4,589,318

[45] Date of Patent: May 20, 1986

[54] MEAT ROLL CUTTING MACHINE

[75] Inventor: Richard O. Kanski, Grand Rapids, Mich.

[73] Assignee: Frederick & Herrud, Inc., Detroit, Mich.

[21] Appl. No.: 696,636

[22] Filed: Jan. 30, 1985

[51] Int. Cl.[4] ..... B26D 3/16

[52] U.S. Cl. ..... 83/409.1; 83/425.3; 83/435; 83/564; 83/858

[58] Field of Search ..... 83/431, 409, 409.1, 83/409.2, 857, 858, 859, 411 R, 54, 56, 425, 425.2, 435, 564, 480, 433, 425.3

[56] References Cited

U.S. PATENT DOCUMENTS

| | | | |
|---|---|---|---|
| 474,233 | 5/1892 | Edwards | 83/410 X |
| 823,797 | 6/1906 | Lupton | 83/479 X |
| 1,433,910 | 10/1922 | Ricci | 83/479 X |
| 2,154,697 | 4/1939 | Phelps | 83/162 X |
| 2,484,619 | 10/1949 | George . | |
| 2,735,466 | 2/1956 | Krstinich . | |
| 2,979,979 | 4/1961 | Hearden et al. | |
| 3,301,199 | 1/1967 | Vassalli . | |
| 3,516,312 | 6/1970 | Nordberg et al. | 83/42 |
| 4,038,892 | 8/1977 | Popeil | 83/431 X |
| 4,041,822 | 8/1977 | Gabel | 83/409.2 |
| 4,329,895 | 5/1982 | Perini | 83/174 |
| 4,383,459 | 5/1983 | Peters | 83/411 R |

FOREIGN PATENT DOCUMENTS 128924 1/1945 Denmark .

*Primary Examiner*—James M. Meister

*Attorney, Agent, or Firm*—Price, Heneveld, Huizenga & Cooper

[57] ABSTRACT

A meat cutting device for cutting long rolls of meat into shorter chunks includes means for conveying long rolls one after another against a plurality of blades, each having converging sharpened edges forming a sharp point. The blades are positioned parallel to one another across and above the path of travel of the rolls and are located so that as a roll is conveyed into the blades, the blade points will pierce through the skin of the roll before the sharpened edges begin to slice through the roll. Preferably the conveyor means includes a table on which support cradles are moved and the blades are positioned above the table with the blade points located above the table so that central axis of the roll is located under the points as the roll is moved through the blades.

20 Claims, 11 Drawing Figures

MEAT ROLL CUTTING MACHINE

BACKGROUND OF THE INVENTION

This invention relates to meat roll or meat log cutting machines for slicing long rolls or logs of soft compressed meats into shorter rolls or chunks.

Rolls or logs of soft meats such as sausage and cold cuts often are prepared in 3–4 foot lengths encased in a protective skin. In packaging this type of meat for retail sale, the rolls are cut or sliced by the processor into shorter rolls or chunks prior to shipment to the retailer.

Devices have been developed to do this kind of slicing automatically and save the expense of doing it manually. Most of these devices employ a plurality of rotating circular blades spaced across a conveyor. Rotating blades, however, do not cleanly slice the meat. Instead, the meat tends to be squashed or smeared against the blades as it is fed by feeding means into the blades. To minimize squashing, the meat must be fed slowly into the blades, but this reduces the speed of the cutting process. Finally, rotating blade machines are quite complicated, requiring motors, bearings and the like to drive and support the blades. Examples of such machines are disclosed in Gabel, U.S. Pat. No. 4,041,822, dated Aug. 16, 1977.

Other types of fixed blade slicing machines have been developed. One such type as disclosed in U.S. Pat. No. 4,383,459 to Peters, dated May 17, 1983, employs a reciprocating mechanism which causes the large roll and a plurality of spaced, straight-edged blades to be forced against each other to impart a slicing motion. Whether the blades are moved toward the meat or vice versa, the meat tends to be squeezed in such machines, particularly when the blades are dull since they will not slice through the protective skin very well causing the meat to be squeezed between the blades and the device carrying the meat. Finally, the reciprocating movement of such machines is quite slow and this device lacks simple, automatic feeding means to feed the rolls of meat into the machine. As a result of the inadequacy of these machines, a substantial portion of meat logs are cut manually creating a danger of injury and other indesirable problems.

SUMMARY OF THE INVENTION

The meat cutting device of the present invention includes a plurality of blades spaced parallel to one another, each of the blades having a point defined between two sharpened edges. A device for moving the roll or log of meat into the blades is provided, and the blades and blade points are shaped and located in a position relative to the movement device such that the points will contact and pierce the meat rolls before the sharpened edges slice into the rolls. In a narrower aspect of the invention, continuous conveying means feeds the rolls one after another into the pointed blades which are stationary relative to the conveying means.

The pointed blades pierce the protective skin of the meat rolls, allowing the sharpened edges on either side of the points to slice into and through the meat roll. The resulting slices are clean, and the meat does not get squashed between the conveyor means and the blades because the points pierce the meat and allow the blades to cleanly cut through the protective covering and the meat.

DETAILED DESCRIPTION OF THE PREFERRED EMBODIMENT

Figure 2:
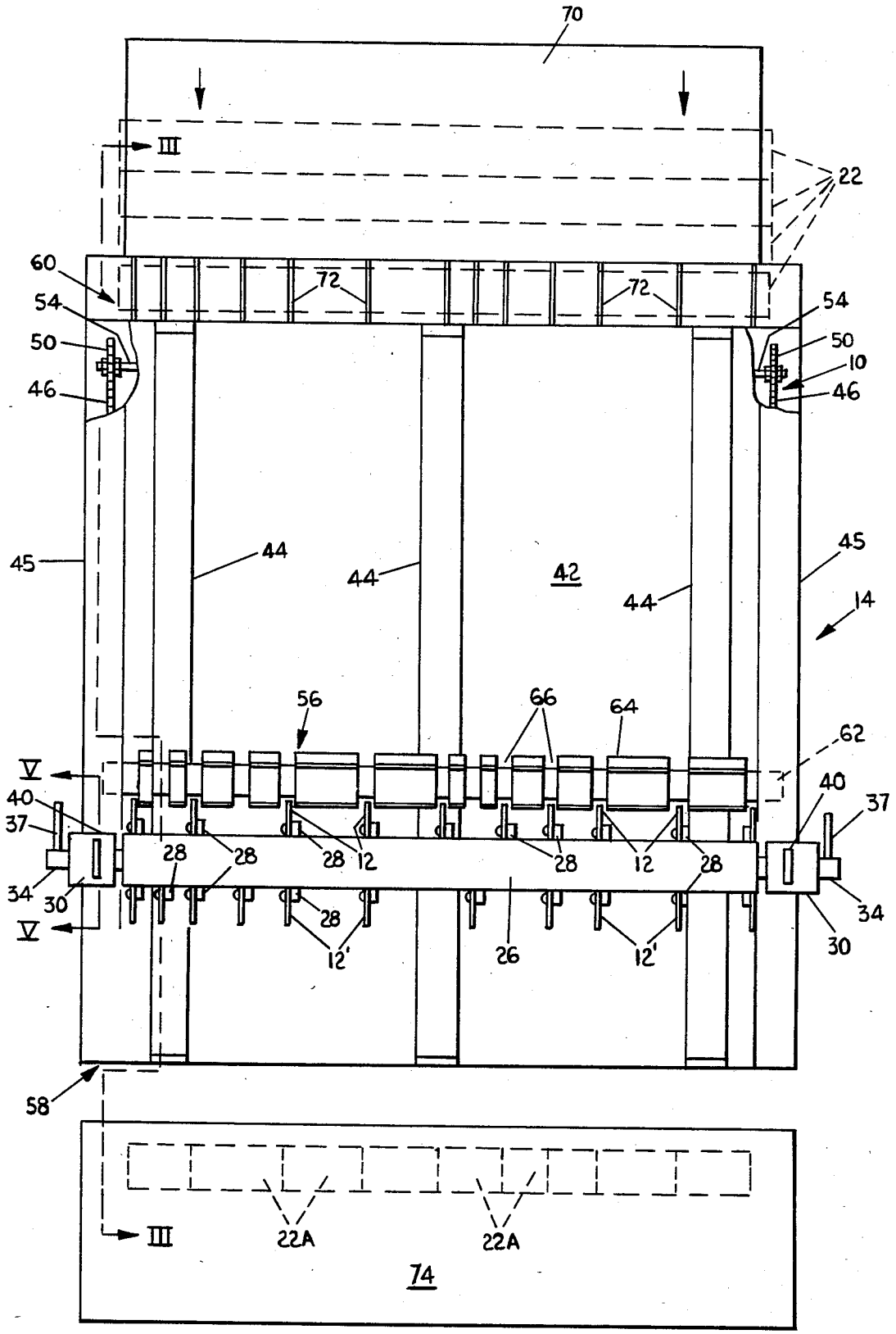
FIG. 2 is a top plan view of the meat cutting device of the present invention disclosing a different carrier on the top surface of the conveyor table.
Figure 4:
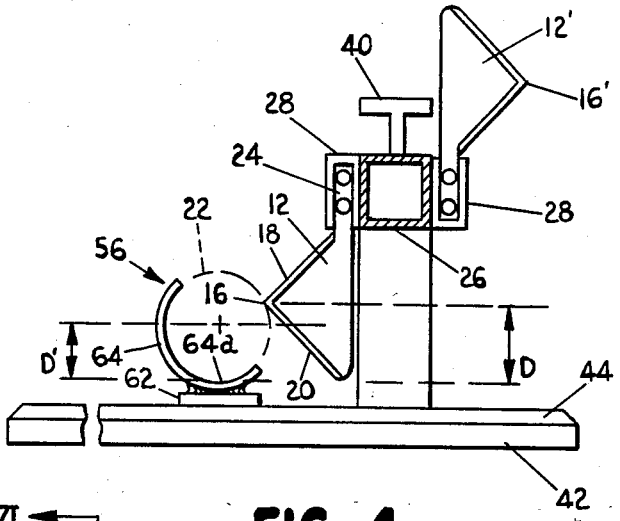
FIG. 4 is a detailed side view of a roll of meat shown in broken lines being presented to a stationary blade of the present meat cutting device.

In the preferred embodiment of the meat cutting device 10 of the present invention, a plurality of parallel stationary blades 12 spaced at various distances from each other are positioned above a conveyor 14. Each blade 12 has a point 16 which is defined between two sharpened edges 18 and 20 (FIG. 4). As rolls of meat 22 are carried across the bed of conveyor 14, the conveyor will present the meat rolls to blades 12. Blades 12 are configured such that points 16 contact and pierce the protective skin encasing the meat rolls before the sharpened edges begin to cut into the meat. As the conveyor keeps pushing each roll 22 into the blades, edges 18 and 20 will progressively slice through the protective skin and the meat roll itself and make a clean slice through the roll. As can be seen in FIG. 2, with a plurality of blades spaced across the conveyor, a plurality of clean cuts will be made in the elongated rolls 22 to slice rolls 22 into a variety of different sized smaller rolls **22*a***.

Figure 10A:
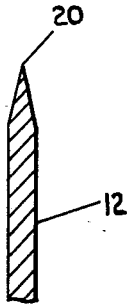
FIGS. 10A and 10B are cross sections taken along the planes of lines XA—XA and XB—XB of FIG. 3, respectively.
Figure 10B:
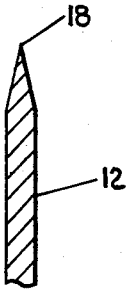
Figure 7:
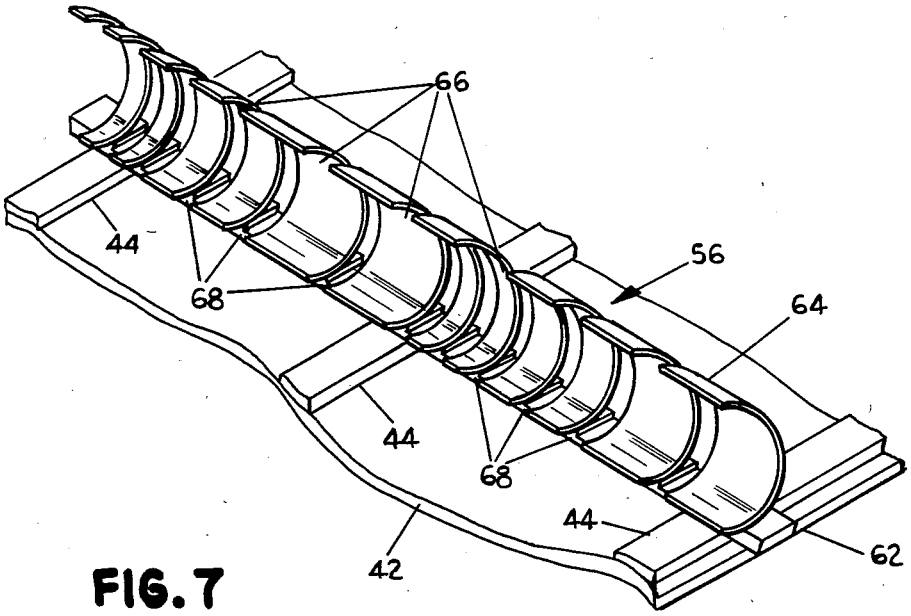
FIG. 7 is a detailed perspective view of a carrier of the present invention.

Each blade 12 is basically a flat sheet of hardened steel having a polygonal shape. Two adjacent edges 18 and 20 are sharpened on both sides of blade 12 (FIGS. 10A and 10B) and converge to form a sharp point 16. Point 16 is located a greater distance D above the portion of the conveyor (FIG. 4) which supports the roll than the distance D′ between such portion and the longitudinal axis of the meat roll 22. Therefore, as a meat roll is forced against edges 18 and 20 of blades 12, the edge 20 applies a downward force on the roll so as to eliminate any tendency for the meat roll to roll up on edges 18 of the blades. Instead of lifting the roll, the piercing of point 16 above the longitudinal axis will force most of the roll below point 16 and under edge 20 such that blades 12 will assist in holding the roll in the conveyor as they cut through the roll.

Each blade 12 has a support arm 24 which extends upwardly from the blade and is connected to a support member 26 which extends across and above the conveyor. Support arm 24 is connected to support member 26 by a block 28 welded to support member 26 and fastened by screw fasteners to arm 24 of blade 12.

Figure 1:
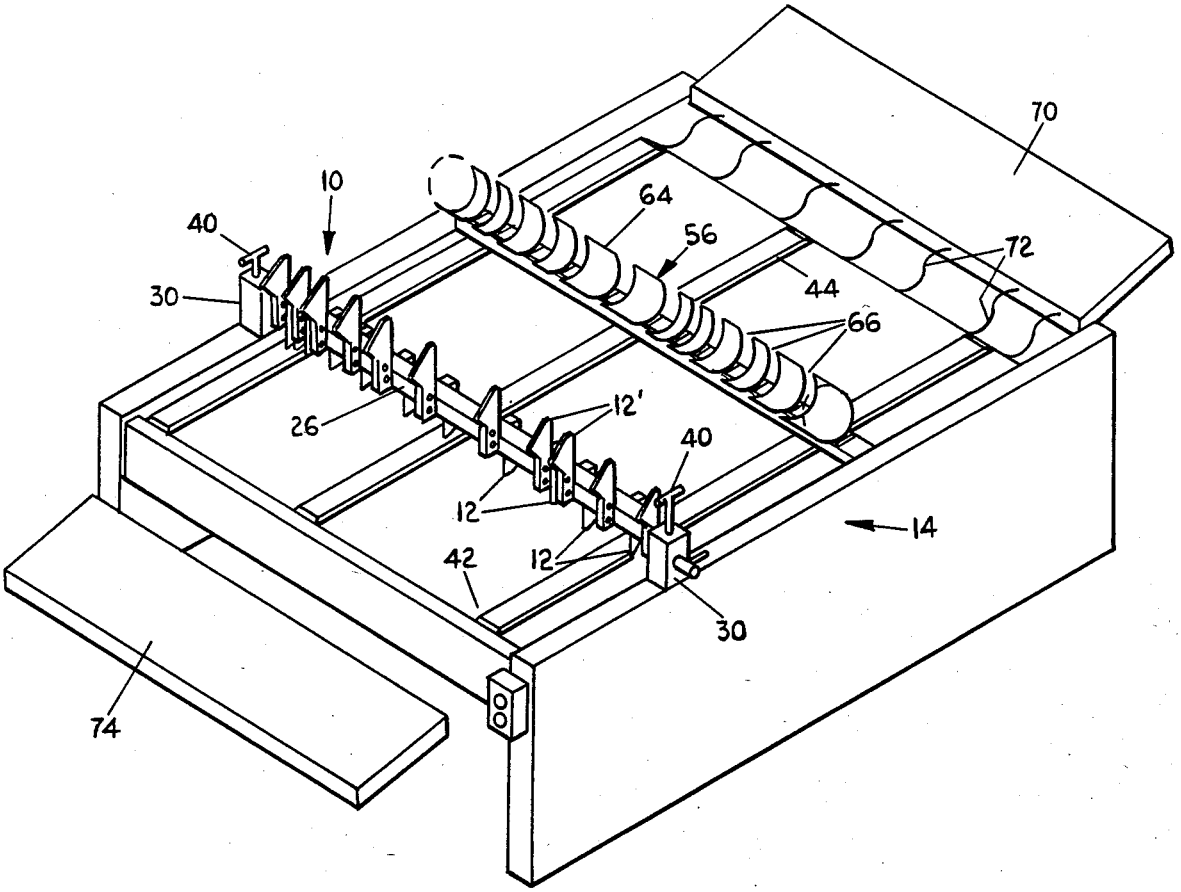
FIG. 1 is a perspective view of the meat cutting device of the present invention disclosing one carrier on the top surface of the conveyor table.
Figure 3:
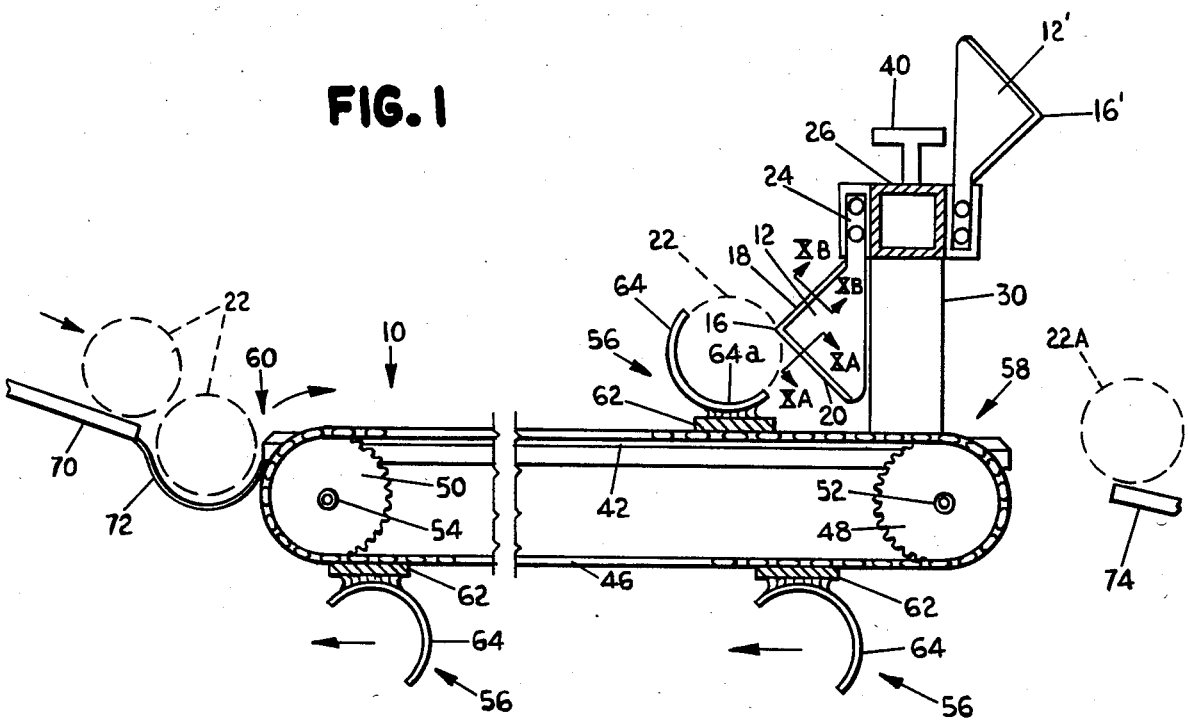
FIG. 3 is a cross section taken along the plane of line III—III of FIG. 2.

Preferably, two sets of blades 12 and 12' (FIGS. 2 and 3) are mounted on support member 26. Support member 26 is rotatable about its longitudinal axis by means to be described. The first and second sets of blades 12, 12' are mounted on support member 26 such that as support member 26 is rotated, one set of blades is presented to the rolls of meat being conveyed along the conveyor while the other set of blades is in a raised, retracted position where they will not contact the meat to be cut. For instance, as shown in FIG. 3, blades 12 are being used as cutter blades while blades 12' are raised and retracted from the path along which rolls 22 are conveyed.

The provision of a second, alternate set of blades 12' is advantageous for a number of reasons. First of all, the spacing between blades 12' can be different from the spacing between blades 12 (FIG. 2) such that different sized chunks are cut from meat rolls 22 when blades 12' are used instead of blades 12. Furthermore, it is possible to have blades 12' with points 16' located a different distance D above conveyor 14 when in cutting position than the distance D when blades 12 are utilized. This facilitates cutting meat rolls of different diameters without sacrificing the advantages in the desired position of the blade points as described above. Finally, even if blades 12 were to have identical shapes and spacings as blades 12', a second set of blades makes it easy to replace the first set of blades while the machine is in operation. Thus, down time for blade replacement due to breakage or dullness of blades is reduced.

Figure 5:
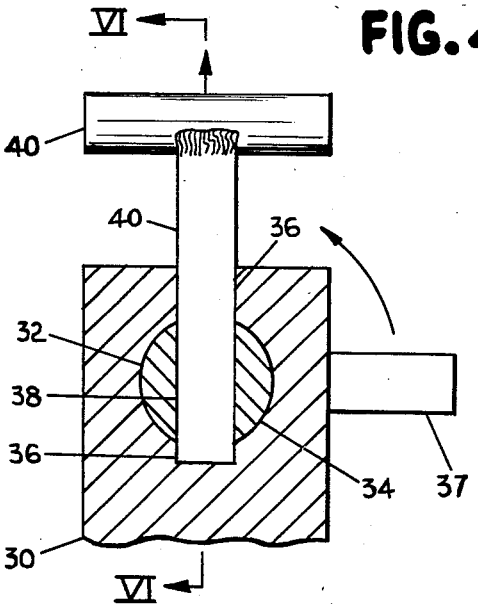
FIG. 5 is a cross section taken along the plane of line V—V of FIG. 2.
Figure 6:
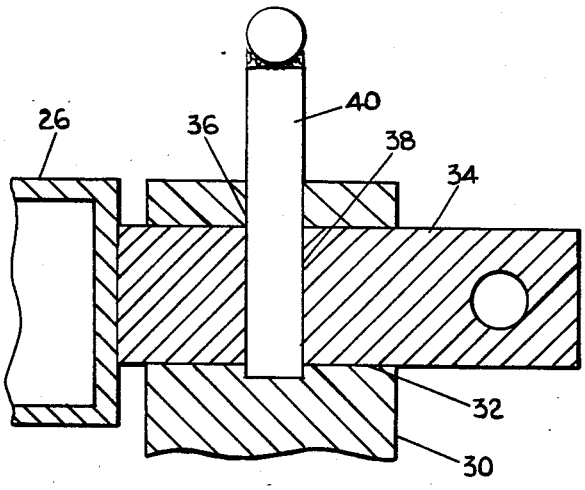
FIG. 6 is a cross section taken along the plane of line VI—VI of FIG. 5.

Support member 26 is supported at each end by a post 30 mounted on the edge of conveyor 14 and extending upwardly therefrom. At its upper end, each post has a lateral bore 32 (FIGS. 5 and 6) which receives a shank 34 extending from the end of support member 26. A locking pin bore 36 extends across lateral bore 32, and is alignable with a shank bore 38 through shank 34 which in turn receives a locking pin 40 to prevent support member 26 from rotating.

To switch blade sets, the locking pins 40 on each end of support member 26 are removed, and support member 26 is rotated 180° by rotating shanks 34 in bores 38. Handles 37 (FIGS. 2, 5 and 6) connected to shanks 34 facilitate this rotation. The pins are reinserted into their respective pin bores 36 and through the now inverted shank bores 38. Since a turn of 180° is required of support member 26 to invert shank bores 38, first and second blade sets 12 and 12' are positioned 180° apart about the longitudinal axis of support member 26 as shown in FIG. 3. Therefore, it is easy to switch blade sets by simply removing two pins, rotating support member 26 and reinserting the same pins.

Conveyor 14 comprises a table 42 preferably made of metal with several runners 44 made from low friction material such as polyethylene running along the length of the table perpendicular to and underneath support member 26.

Figure 8:
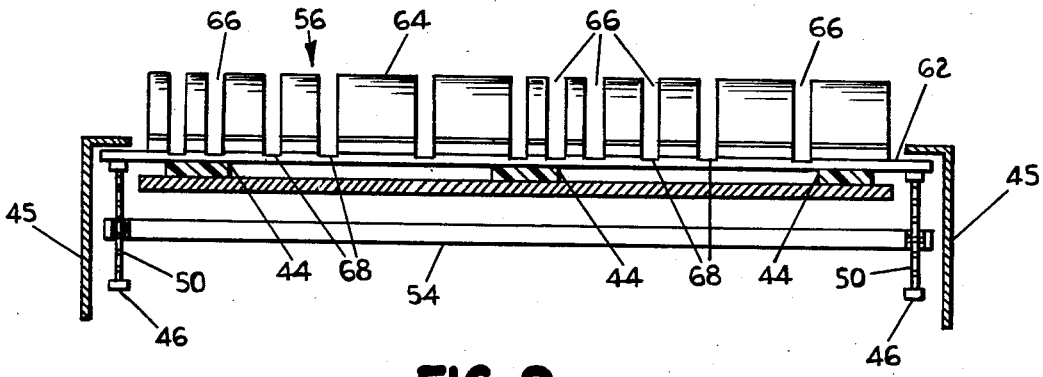
FIG. 8 is a cross section taken along the plane of line VIII—VIII of FIG. 3.

On both sides of conveyor 14 and table 42, parallel to runners 44, is an endless chain 46 supported at one end by drive gears 48 and at the other end by driven gears 50. Drive gears 48, which are driven by means not shown, are connected by a drive shaft 52. Driven gears 50 are connected by a driven shaft 54 so that the two chains 46 are driven in tandem with each other at the same speed. On either side of conveyor 14 there is a shroud 45 (FIGS. 2 and 8) which covers the chains.

Extending between chains 46 across conveyor 14 are a plurality of carriers 56. Carriers 56 carry the meat rolls 22 into blades 12 to be cut by the blades. Carriers 56 are spaced from each other around endless chains 46 so that they are driven one after another across the top of table 42, through blades 12, over the end 58 of table 42, under table 42, and back up the beginning 60 of table 42 to move across the top of the table once again. Carriers 56 are substantially identical to one another, so only one needs to be described in detail.

Each carrier 56 includes a support pad 62 and an arcuate cradle 64 having a lower support portion 64*a* on which the roll is seated. A plurality of slots 66 are cut through cradle 64. Support bar or pad 62 is basically a metal bar connected at each end to one of the endless chains 46. Cradle 64 is arcuate in configuration and is welded to the upper surface of support bar 62. The radius of curvature of cradle 64 basically corresponds to the radius of the meat rolls 22 to be conveyed along the conveyor.

As shown in FIG. 2, each slot 66 is positioned to allow at least one of blades 12 or 12' pass through it, depending upon which set of blades is retracted and which is lowered. Thus, slots 66 allow the blades to pass through cradle 64 and slice the meat roll within the cradle.

Figure 9:
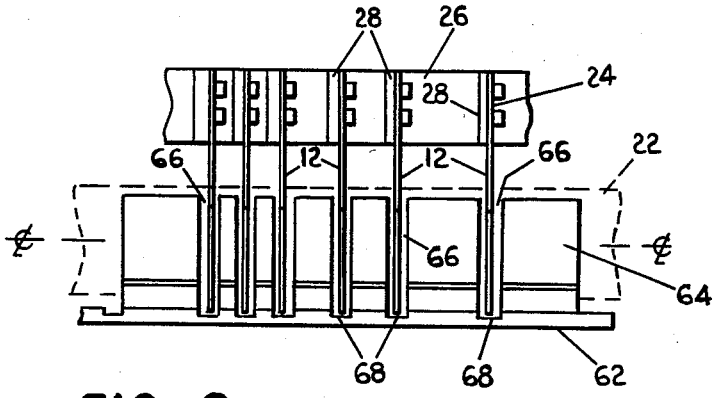
FIG. 9 is a detailed view of the carrier of FIG. 2 passing beneath the cutting blades of the meat cutting device of the present invention.

As shown in FIG. 9, support pad 62 has a plurality of recesses 68 across its upper surface, each recess being located below one of the slots 66 in cradle 64. As support pad 62 passes beneath blades 12, blades 12 will extend into recesses 68 so that the blades will extend below and completely cut through the meat roll because the bottoms of recesses 68 are lower than the bottom of the cradle.

Carriers 56 are fed by a feeding device such as feeding ramp 70 (FIG. 3). Feeding ramp 70 slopes downwardly to the beginning 60 of table 42. The lower end of feed ramp 70 is spaced from the beginning 60 of table 42, and a plurality of support fingers or hooks 72 extend from the lower end of ramp 70 across the gap between the lower end of ramp 70 and table 42. Fingers 72 are curved such that they can cradle a meat roll 22, and they are spaced from each other such that as a carrier 56 is drawn around the beginning end 60 of table 42, each finger 72 will pass through a slot 66 in cradle 64. Accordingly, a cradle 64 will pick up a meat roll 22 supported by fingers 72, allowing another meat roll to roll from the lower end of feed ramp 70 into the fingers to be picked up by the next carrier.

At the end 58 of conveyor 14, an outfeed table 74 slopes downwardly away from conveyor 14. The upper end of outfeed table 74 is spaced from end 58 of conveyor 14 to allow carriers 56 to go around end 58 from the top of the table and move across the bottom. As a carrier 56 begins to tilt when it is drawn over end 58, its cradle 64 tilts, and the sliced meat rolls 22*a* drop onto the upper end of outfeed table 74. The sliced rolls 22*a* then roll down the outfeed table into a hopper (not shown) or into the feed means for a packaging apparatus (not shown).

OPERATION

The operation of the device should be apparent at this point, but will be explained in detail. First, meat rolls 22 are fed onto or placed on feed ramp 70, and the first roll 22 will roll into fingers 72. The machine is turned on, and carriers 56 begin to move across and underneath the conveyor. The first carrier 56 to move over beginning end 60 of conveyor 14 will pick the first meat roll 22 from fingers 72 and carry it across the top of the table 42, low friction runners 44 allowing carrier 56 to be drawn effortlessly across the table top. The first roll ladened carrier will approach the cutter blades as one or more following carriers begin to pick up additional rolls 22. As the first carrier forces its roll against blades 12, the points 16 of blades 12 will contact the roll above its longitudinal axis, pierce the protective covering or casing of the roll, and slice through the roll while forcing the roll downwardly on its support to assist in holding the roll in the carrier. This is accomplished by the roll being captured between the lower sharpened edge 20 and carrier 56 as the roll is pushed through the blades. After blades 12 pass through roll 22, they will pass through cradle 64 and through slots 66. Carrier 56 will then deposit the sliced rolls **22*a* on the outfeed table 74 as carrier 56 is drawn over end 58 of conveyor 14 to be moved back to the beginning 60 of the conveyor. As the first carrier passes over the end, subsequent carriers will present other rolls for cutting by blades 12. If blades 12 become dull, the alternate blades 12' can be pivoted into position by removing locking pins 40, rotating support member 26 180°, and reinserting locking pins 40** into the bores which receive them.

It is possible to have the machine operate virtually automatically by positioning feed ramp 70 at the end of other processing equipment such that feed ramp 70 is continuously fed with meat rolls.

Because the pointed blades pierce the protective skin, the meat is not squashed or smeared against the blades as in prior art automatic meat roll cutting devices. Furthermore, the device is quite simple, requiring only one motor to drive drive gears 48 and drive shaft 52. There is no need for a complicated drive mechanism to drive a plurality of rotating circular blades. Finally, if one of the blades becomes dull or breaks, the machine need not be completely shut down to replace it. Instead, a new set of blades is pivoted into position.

Although one preferred embodiment of the invention has been disclosed and described above, other embodiments of the invention will be apparent to those skilled in the art. Such embodiments are to be considered within the scope of the invention which is defined by the claims which follow.

The embodiments of the invention in which an exclusive property or privilege is claimed are defined as follows.

1. A meat cutting device for cutting long rolls of soft meat into shorter chunks, comprising:

(a) conveying means for continuously conveying rolls of meat one after the other along a path;

(b) a plurality of parallel stationary blades disposed spacedly from one another across said path;

(c) each of said blades having a sharp point formed between two adjacent sharpened edges normal to said path, said point being disposed to contact and pierce a roll of meat conveyed along said path before said edges make substantial contact with the roll;

whereby as a roll is conveyed into each blade, said point will pierce through the skin of said roll and said one edge will slice through the roll and skin on one side of said point and said other edge will slice through the roll and skin on the other side of said point.

2. The meat cutting device as recited in claim 1 wherein said conveying means includes support means having a portion thereof contacting and supporting a roll on at least one side, said roll when so supported extending across said path; said support means being movable along said path with said portion being movable on a plane spaced from the points of said blades; said points being located so that said axis of each roll conveyed through said blades passes between said plane and said points whereby an edge of the blade as it cuts through said roll forces it toward said portion to assist in holding said roll on said support means.

3. The meat cutting device as recited in claim 1 wherein said two edges form no more than an obtuse angle with respect to each other at said point.

4. The meat cutting device as recited in claim 1 wherein said conveying means includes a carrier having an arcuately shaped cross section adapted to cradle a roll and support and carry a roll on its side, said carrier having a plurality of gaps along its longitudinal length, each of said gaps being aligned with one of said blades to allow said blades to pass through said carrier.

5. The meat cutting device as recited in claim 1 wherein said blades are spaced at various distances from one another so as to cut smaller rolls of various sizes from a larger roll of meat.

6. The meat cutting device as recited in claim 1 wherein first and second sets of said blades are provided, one set being retractable as the other set is moved into cutting position.

7. The meat cutting device as recited in claim 6 which further comprises an elongated support member disposed above said conveyor means for supporting said two sets of blades, said support member being selectively pivotal about its longitudinal axis and said two sets being at displaced positions from each other on said support member about the longitudinal axis thereof, whereby said support member can be rotated about its longitudinal axis to selectively present one of said sets of blades to rolls of meat being conveyed by said conveyor means.

8. The meat cutting device as recited in claim 7 wherein said two sets of blades are mounted 180° offset from each other about the longitudinal axis of said support member, and wherein said device further includes a shank at each end of said support member, a riser member at each end of said support member operatively connecting said conveyor means and support member, each riser member having a first bore which receives one of said shanks, and a second bore extending at a right angle into said first bore, each of said shanks having a third bore extending through it alignable with said second bore, and a locking pin removably received within each of said second bores and extending into said third bores, whereby said locking pin can be removed and said support member pivoted 180° to switch blade sets and said locking pins reinserted into said second and third bores to lock said support member in the pivoted position.

9. The meat cutting device as recited in claim 6 wherein said second blades are spaced at different intervals from each other than said first blades.

10. The meat cutting device as recited in claim 6 wherein the points of said first and second blades when in cutting position are located at different positions with respect to said conveying means whereby meat rolls having different diameters can be sliced on the same machine by selecting different sets of blades.

11. The meat cutting device as recited in claim 10 wherein said conveying means includes a carrier having an arcuately-shaped cross section adapted to cradle a roll and support and carry a roll on its side, said carrier having a plurality of gaps along its longitudinal length, each of said gaps being aligned with a blade in one of said two sets of blades to allow either set of blades to pass through said carrier.

12. The meat cutting device as recited in claim 1 wherein said conveying means includes a table positioned underneath said blades; at least two carriers; endless drive means for driving said carriers across the top of said table, over one edge of the table, then underneath the table to a second edge of said table and over the second edge back across said top, said carriers passing under and through said blades as they cross said top; and feed means at said second edge for feeding said carriers with rolls to be cut.

13. The meat cutting device as recited in claim 12 wherein said feed means includes a ramp sloping downwardly toward said second edge, and a plurality of spaced, curved fingers extending from the bottom of said ramp toward said second edge, said fingers being spaced from each other and extending sufficiently far toward said second edge that said fingers pass through said gaps as said carriers move over said second edge, whereby a plurality of meat rolls can be placed on said ramp and the roll at the bottom of said ramp will roll into said fingers, whereupon said carriers moving over said second edge will pick up the bottom roll from said fingers and carry it across said top of said table, the roll being sliced by said blades as said carrier passes through said blades.

14. The meat cutting device as recited in claim 7 wherein said second blades are spaced at different intervals from each other than said first blades.

15. The meat cutting device as recited in claim 7 wherein the points of said first and second blades when in cutting position are located at different positions with respect to said conveying means whereby meat rolls having different diameters can be sliced on the same machine by selecting different sets of blades.

16. The meat cutting device as recited in claim 4 wherein said conveying means includes a table positioned underneath said blades; at least two carriers; endless drive means for driving said carriers across the top of said table, over one edge of the table, then underneath the table to a second edge of said table and over the second edge back across said top, said carriers passing under and through said blades as they cross said top; and feed means at said second edge for feeding said carriers with rolls to be cut.

17. A meat cutting device for cutting a long roll of meat into shorter chunks, comprising:

a plurality of blades spaced parallel to one another, each of said blades having a point defined between two sharpened edges;

support means for supporting at least one roll of meat extending lengthwise in a direction spanning said spaced blades;

motive means for causing relative movement between said blades and rolls for causing said blades to cut said meat roll into shorter chunks; and said blades and blade points being shaped and positioned relative to a roll on said support means such that said points contact and pierce the meat roll before said sharpened edges slice into the roll.

18. The meat cutting device of claim 17 which includes a table; one of said support means or blades being mounted stationarily on said table; endless drive means for driving the other of said support means or blades across the top of said table, over one edge of the table, then underneath the table to a second edge of said table and over the second edge back across said top whereby a roll of meat supported by said support means is cut by said blades into shorter chunks.

19. The meat cutting device of claim 17 in which the meat roll support means includes a portion thereof which supports the roll on one side, said portion being located on a plane spaced from the points of said blades; said points being located so that the axis of said roll is located between said portion and said points as said motive means causes relative movement between said blades and roll whereby an edge of the blade as it cuts through said roll forces it toward said portion to assist in holding said roll on said support means.

20. The meat cutting device of claim 18 in which the meat roll support means includes a portion thereof which supports the roll on one side, said portion being located on a plane spaced from the points of said blades; said points being located so that the axis of said roll is located between said portion and said points as said motive means causes relative movement between said blades and roll whereby an edge of the blade as it cuts through said roll forces it toward said portion to assist in holding said roll on said support means.

* * * * *